United States Patent [19]

Purchase

[11] 3,957,298

[45] May 18, 1976

[54] TOAST TONGS

[76] Inventor: Herbert K. Purchase, 5550 Columbia Pike, Apt. 641, Arlington, Va. 22204

[22] Filed: Dec. 3, 1974

[21] Appl. No.: 529,227

[52] U.S. Cl. ..... 294/33; 294/16; 294/99 R; 294/104

[51] Int. Cl.[2] ..... A47G 21/10; A47J 43/28

[58] Field of Search ..... 294/1 R, 3, 6–8, 294/8.5, 11, 13, 16, 27–31 R, 33, 50, 9, 99 R, 103, 104, 106; D7/99, 105; 24/248 R, 255 R, 255 FH, 255 P, 255 TZ; 30/147–150; 81/43; 99/394, 421 A; 128/321, 354; 132/75.6, 76.4

[56] References Cited

UNITED STATES PATENTS

| | | | |
|---|---|---|---|
| 855,949 | 6/1907 | Hoffman | 294/99 R X |
| 1,004,871 | 10/1911 | Gundorph | 81/43 |
| 1,197,451 | 9/1916 | Curl | 81/43 X |
| 1,616,355 | 2/1927 | Considine | 128/354 |
| 1,643,456 | 9/1927 | James | 294/99 R X |
| 3,318,318 | 5/1967 | Gewirz | 132/76.4 |
| 3,807,781 | 4/1974 | Rollband | 294/16 |

*Primary Examiner*—Evon C. Blunk
*Assistant Examiner*—Johnny D. Cherry
*Attorney, Agent, or Firm*—Adolph C. Hugin

[57] ABSTRACT

Tongs particularly adapted for removal of toasts, English muffins, and the like from electric toasters and having a pair of fingers made of flexible insulating material, such as thin laminar wood similar to a conventional tongue depressor, each secured adjacent to an end thereof to a spacer and mounting member, such as a wooden dowel. One of the fingers being fixedly secured as by a brad and glue to one side of the spacer and mounting member, and the other finger being tightly rotatably mounted on the opposite side of the spacer and mounting member. One or both of the fingers, and preferably all sides of the stated other finger, are formed with roughened surfaces, as by an emery coating applied thereto, extending from adjacent to and slightly from the mounting member to the outer end of the finger, thereby providing for exerting a firmer engagement and pressure thereon for more securely gripping an object and also adapted to be used for scraping surfaces and edges of toasts to remove overly-darkened or burned parts of toasts, muffins, and the like.

3 Claims, 4 Drawing Figures

FIG. 1
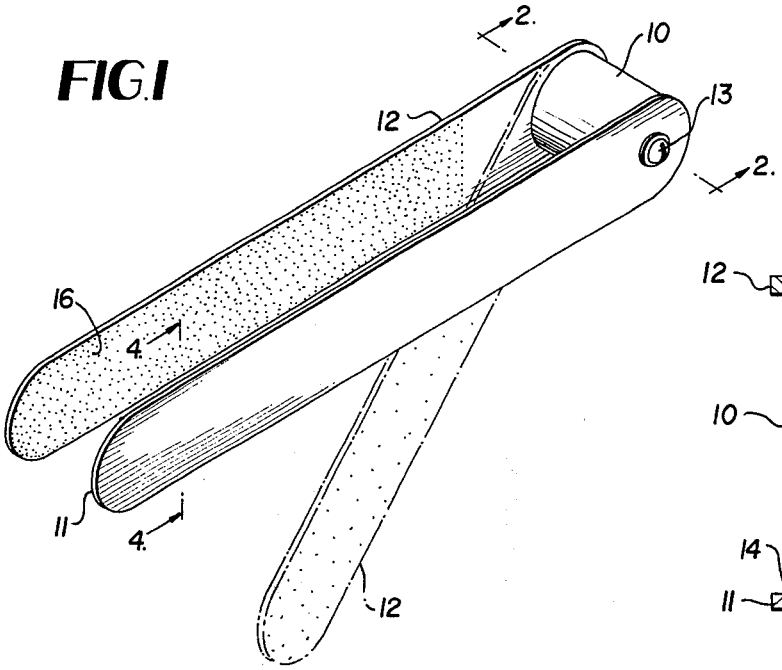
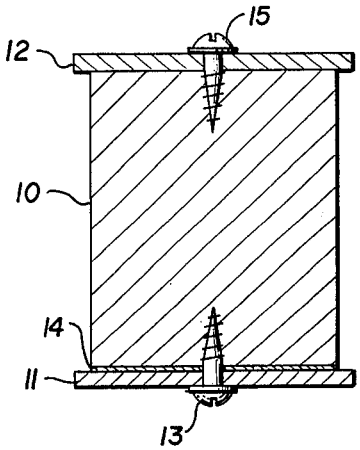
FIG. 2
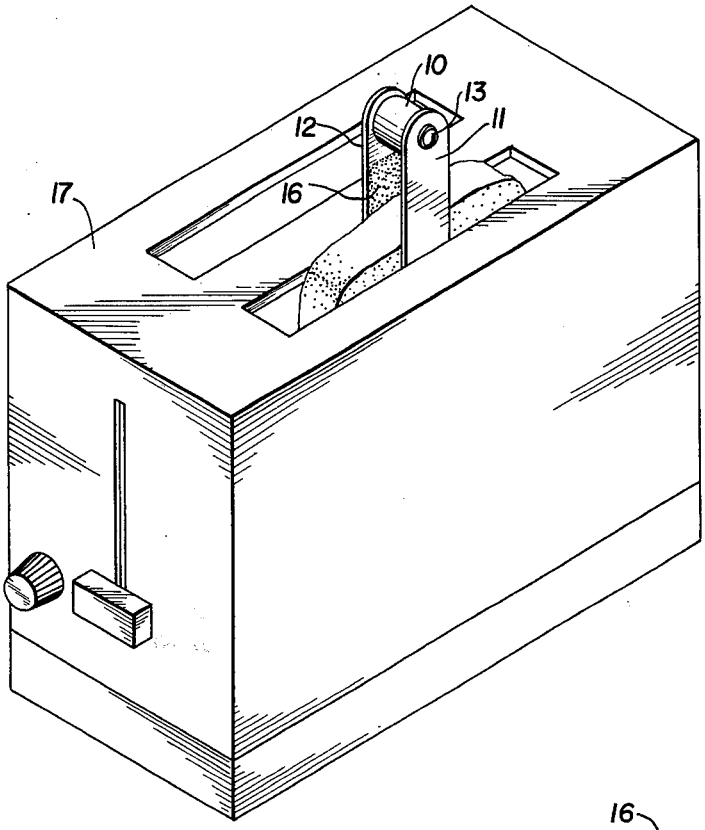
FIG. 3
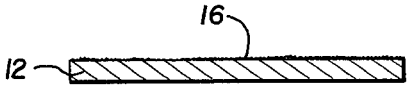
FIG. 4

TOAST TONGS

FIELD OF INVENTION

This invention pertains to tongs and particularly to improved tongs for the safe and easy removal of toasts, English muffins, and the like from electric toasters.

BACKGROUND OF INVENTION

Tongs of many types have been used for lifting, carrying, and holding a large variety of objects. Many have comprised a pair of fingers connected together at one end and which could be moved, flexed, or otherwise biased toward one another for grasping an object. Generally, a resilient means is provided for biasing the fingers apart to release their grasp on an object. In some instances, the flexibility of the fingers permits moving them inwardly for grasping an object and for biasing them apart by removal of the flexing pressure thereon for releasing the object. In most cases, the tongs, including the fingers, are formed of metal, although bamboo fingers have been pivotally secured together to form modified chop sticks.

U.S. Pat. Nos. 61,051—Clark; 385,498—Brinton; 855,949—Hoffman; 3,115,360—Witkoff; 3,214,210—Keirn; and 3,414,310—Ono are illustrations of tongs of the foregoing types particularly adapted to holding small objects, such as articles of food. These generally have the disadvantage of being electrically conductive and consequently dangerous if used to remove toasts, English muffins, and the like from an electric toaster when it has not been disconnected from the source of electric power. Even with pop-up toasters, the toast or muffin often sticks in the sides of the toaster and some type of wedge often is used to dislodge the stuck toast or muffin from the toaster. Thus, it becomes essential, both for safety from electric shock and for preventing damage to the toaster, to turn off or disconnect the toaster before inserting a metal dislodging tool into the toaster. In addition, when a toast or muffin has thus become stuck in the toaster, it generally is over-browned or at least partially burned at one or more edges, thus requiring scraping off the burned parts. None of the present type tongs is adapted to provide these functions with ease and safety.

SUMMARY OF THE INVENTION

The present invention comprises simplified and improved tongs, wherein a pair of inherently flexible insulating-material fingers, such as thin laminar wooden elements, are secured adjacent one end thereof to a spacer and mounting member. The latter member may conveniently be a cylindrical dowel to one side or flat end of which an end of one finger is fixedly secured, as by a brad and glue, and to the opposite side or flat end of which an end of the other finger is tightly mounted rotatable substantially parallel to the fixedly mounted finger. The adjacent inner faces of the fingers are substantially plane parallel surfaces which facilitate a firm grip of the toast or similar object, and the inherent flexibility of the fingers transversely of the narrow depth or thickness thereof further ensures this firm gripping action.

In addition, one or both fingers, and preferably the rotatably mounted finger, are formed with a roughened surface over substantially a large portion thereof, as by a surface coating of emery or the like extending from adjacent to and not including the part thereof which engages the side of the spacer and mounting member. This provides for a firmer grip and engagement of the fingers for tightly grasping a toast stuck in a toaster. It also advantageously has the highly practical use as a scraper for removing overly darkened or burned surfaces or edges of toasts, or the like, simply by rotating the rotatably mounted finger away from the fixedly mounted finger and scraping the burned parts to be removed with the rough finger surface or edge.

An object of this invention is to provide improved tongs.

Another object of this invention is to provide improved insulated tongs.

Further objects and advantages of this invention will be apparent from the following description referring to the accompanying drawing, and features of novelty which characterize this invention will be pointed out with particularity in the claims appended to and forming a part of this application.

BRIEF DESCRIPTION OF FIGURES OF THE DRAWING

In the drawing:

FIG. 1 is a perspective view of an embodiment of tongs according to one form of this invention, also showing in dot-dash lines the manner in which one of the fingers can be rotated on its mounting;

FIG. 2 is an enlarged sectional view, taken on a plane along line 2—2 of FIG. 1, illustrating the mounting of the fingers on the spacing and mounting member;

FIG. 3 is a perspective view illustrating the use of the tongs according to this invention for extracting a toast stuck in a conventional pop-up electric toaster; and FIG. 4 is an enlarged sectional view, taken along line 4—4 of FIG. 1, illustrating the rough surface coating on the rotatably mounted finger.

DETAILED DESCRIPTION OF THE INVENTION

Referring to the drawing, improved tongs according to one embodiment of this invention are illustrated. These tongs include a spacer and mounting member 10 which may conveniently be formed as a cylindrical wooden dowel, although not limited to such a shape or material. A pair of tong fingers 11 and 12, formed of inherently flexible insulating material, such as thin laminar wood similar to a conventional tongue depressor, are secured to opposite sides or ends of the spacer and mounting member. As shown in FIG. 1, these fingers preferably have plane parallel inner and outer sides or faces extending throughout the lengths thereof and are fitted and mounted on correspondingly flat ends or or sides of the member 10. Fingers of this configuration are substantially rigid transversely thereof in the plane of the inner faces of the fingers and relatively inherently flexible in a direction perpendicular thereto.

In the illustrated embodiment, the finger 11 is fixedly secured at one end thereof to a side of the spacer and mounting member 10 in any suitable manner, as by a suitable screw, brad, or similar element 13 and a suitable glue 14 between the dowel 10 and the end of the finger 11. An end of the finger 12 is tightly rotatably secured as by a screw 15, brad, or other suitable fastener to the end of the dowel 10, opposite the end of the dowel to which the finger 11 is secured. In this embodiment, the finger 12 preferably is formed with a roughened surface on at least a substantial portion thereof, preferably only on the inner face thereof, and extending from adjacent to its engagement with the dowel 10 but not including the part which engages the dowel to the outer or free end of the finger. Such a rough surface may conveniently be provided by a surface coating 16 of emery or similar material on the desired portion of the finger. This enables the exertion of a firmer pressure through this finger for more securely gripping an object, such as a toast stuck in a pop-up electric toaster 17, as shown in FIG. 3. This improvement is obtainable by coating either both or either of the fingers on one or both sides. This feature also has the highly practical use of providing a scraper for removing burned or overly-darkened surfaces which usually result when a toast or similar object gets stuck in a toaster. The finger 12 is simply rotated on its mounting 15 away from the finger 11, as indicated in dot-dash lines in FIG. 1, so as to present the rough surface for scraping the burned portion of the toast.

While a particular embodiment of this invention has been described and illustrated, modifications thereof will occur to those skilled in the art. It is to be understood, therefore, that this invention is not to be limited to the exact details disclosed.

The invention claimed is:

1. Tongs including a block-like finger spacing and mounting member, a pair of tong fingers having substantially plane inner and outer faces extending throughout the lengths thereof, means for fixedly securing one end of one of said fingers to a side of said spacing and mounting member, means for tightly mounting one end of the other of said fingers on the opposite side of said spacing and mounting member spaced from and rotatable substantially parallel to said one finger, said fingers being formed of thin insulating material and being substantially rigid transversely thereof in the planes of the inner faces and flexible at right angles thereto, and at least one of said fingers having a roughened surface on a substantial portion of the inner face thereof exclusive of the part which engages said spacing and mounting member.

2. Tongs as defined in claim 1 wherein said fingers comprise relatively thin laminar wooden elements having substantially parallel plane inner and outer faces, and said roughened face surface comprises a rough surface coating extending from adjacent to said spacing and mounting member to the outer free end of said finger.

3. Tongs as defined in claim 2 wherein said roughened surface comprises a surface coating of emery.

* * * * *